US007422348B1

(12) United States Patent
Yates, II

(10) Patent No.: US 7,422,348 B1
(45) Date of Patent: Sep. 9, 2008

(54) LIGHTING APPARATUS FOR ILLUMINATION OF REMOVABLE FRAME SIGN

(76) Inventor: John E. Yates, II, 4518 Biles Ct., Louisville, KY (US) 40241

( * ) Notice: Subject to any disclaimer, the term of this patent is extended or adjusted under 35 U.S.C. 154(b) by 190 days.

(21) Appl. No.: 11/268,159

(22) Filed: Nov. 7, 2005

(51) Int. Cl.
*F21V 15/00* (2006.01)
*G09F 13/00* (2006.01)

(52) U.S. Cl. ..... 362/364; 362/184; 40/549; 40/572

(58) Field of Classification Search ..... 362/184, 362/249, 364, 396; 40/502, 540
See application file for complete search history.

(56) References Cited

U.S. PATENT DOCUMENTS

| | | | | |
|---|---|---|---|---|
| 1,735,040 | A | 11/1929 | Frederick | |
| 4,009,535 | A | 3/1977 | Stock | |
| 4,319,310 | A | 3/1982 | Kingsley | |
| 4,947,300 | A | 8/1990 | Wen | |
| 5,101,329 | A | 3/1992 | Doyle | |
| 5,192,944 | A | 3/1993 | Otsuki et al. | |
| 5,309,656 | A * | 5/1994 | Montgomery | 40/442 |
| 5,435,087 | A | 7/1995 | Karkar et al. | |
| 5,467,076 | A | 11/1995 | Ruocco et al. | |
| 5,573,328 | A | 11/1996 | Hwang | |
| D379,545 | S | 5/1997 | Houghton et al. | |
| 5,729,924 | A | 3/1998 | Reading | |
| 6,023,869 | A | 2/2000 | Durbin | |
| 6,060,658 | A | 5/2000 | Yoshida et al. | |
| 6,131,321 | A | 10/2000 | Daigle, Jr. | |
| 6,263,601 | B1 | 7/2001 | Emert | |
| 6,604,840 | B2 | 8/2003 | Watson | |
| 7,231,735 | B2 * | 6/2007 | Gelbert | 40/541 |
| 2006/0291241 | A1 * | 12/2006 | Wojtowicz et al. | 362/604 |

* cited by examiner

*Primary Examiner*—John A Ward
(74) *Attorney, Agent, or Firm*—John Salazar; Chad Bruggeman; Middleton Reutlinger

(57) ABSTRACT

A lighting apparatus preferably for use with a removable frame sign includes a light canopy for illuminating the sign when ambient light is less than a predetermined level. The light canopy easily attaches to the frame and illuminates the surfaces of the sign through an arrangement of a plurality of light sources positioned in elongated recesses. The light sources are electrically connected with a rechargeable battery, light sensor, and a solar panel. The solar panel contained in the light canopy is protected and covered by a translucent cover. The lighting apparatus can be readily removed from the sign to allow for interchangeability of the signage and extends the time period for sign visibility during low levels of ambient light.

20 Claims, 4 Drawing Sheets

LIGHTING APPARATUS FOR ILLUMINATION OF REMOVABLE FRAME SIGN

BACKGROUND OF THE INVENTION

1. Field of the Invention

The present invention relates to an apparatus for illuminating signs, preferably removable frame signs such as real estate signs.

2. Description of Related Art

Various illuminated signs have been proposed in the art. These devices generally include house address sign housings with related lighting elements, complete commercial lighted signage panels, or lighting street signs. Existing devices do not provide a lighting apparatus for removable frame signs such as real estate signs.

Therefore, it is desirable to have a lighting apparatus which may be releasably mounted to a removable sign frame to illuminate the surfaces of the sign, such as a real estate sign. Illuminated by the apparatus, the sign becomes visible in low levels of ambient light permitting viewers to take notice of the existence of the sign and the substantive information displayed.

SUMMARY OF THE INVENTION

The lighting apparatus of the present invention allows for the illumination of signs, preferably removable frame signs such as real estate signs. The lighting apparatus results in illuminating the sign panels when ambient light is less than a predetermined level. The lighting apparatus is attached to the removable sign frame between parallel plates that position and secure the sign frame. Attaching the lighting apparatus to the frame of the sign and not to the sign itself allows the sign panels to be interchangeably removed or replaced.

Within the lighting apparatus are the electronics necessary to power the light sources; these include a rechargeable battery, power on/off switch, light sensor, circuit board, and solar panel. The solar panel contained in the light canopy is protected and covered by a translucent cover. The light sensor is connected to the rechargeable battery in such a way that current is permitted to energize the lights only when the light sensor detects a level of ambient light that is below a predetermined light level. A power on/off switch is used in conjunction with the electrical system to turn off the lighting apparatus to maintain rechargeable battery power for later use or transportation.

The lighting apparatus has two recesses running longitudinally adjacent to each side of the lighting apparatus to position the light sources to illuminate each side of the sign. The recesses minimize the direct glare from the light sources and focus the emitted light onto each side of the removable frame sign.

Therefore, a general object of this invention is to provide a lighting apparatus that may be releasably attached to a real estate sign frame allowing the sign panels to be interchangeable.

Another object of this invention is to provide a lighting apparatus, as aforesaid, which utilizes a rechargeable battery and a solar panel to energize a plurality of lights.

Yet another object of this invention is to provide a lighting apparatus, as aforesaid, which permits current to energize the lights only when an ambient light level is less than a predetermined level.

A further object of this invention is to provide a lighting apparatus, as aforesaid, which utilizes a translucent cover to protect the solar panel, preferably a flat solar panel to maximize light reaching the surface of the solar panel.

A still further object of this invention is to provide a lighting apparatus, as aforesaid, having recesses for arranging lights to project light onto the surfaces of the sign.

Other objects and advantages of this invention will become apparent from the following description taken in connection with the accompanying drawings, wherein is set forth by way of illustration and examples, embodiments of this invention.

DETAILED DESCRIPTION

Figure 1:
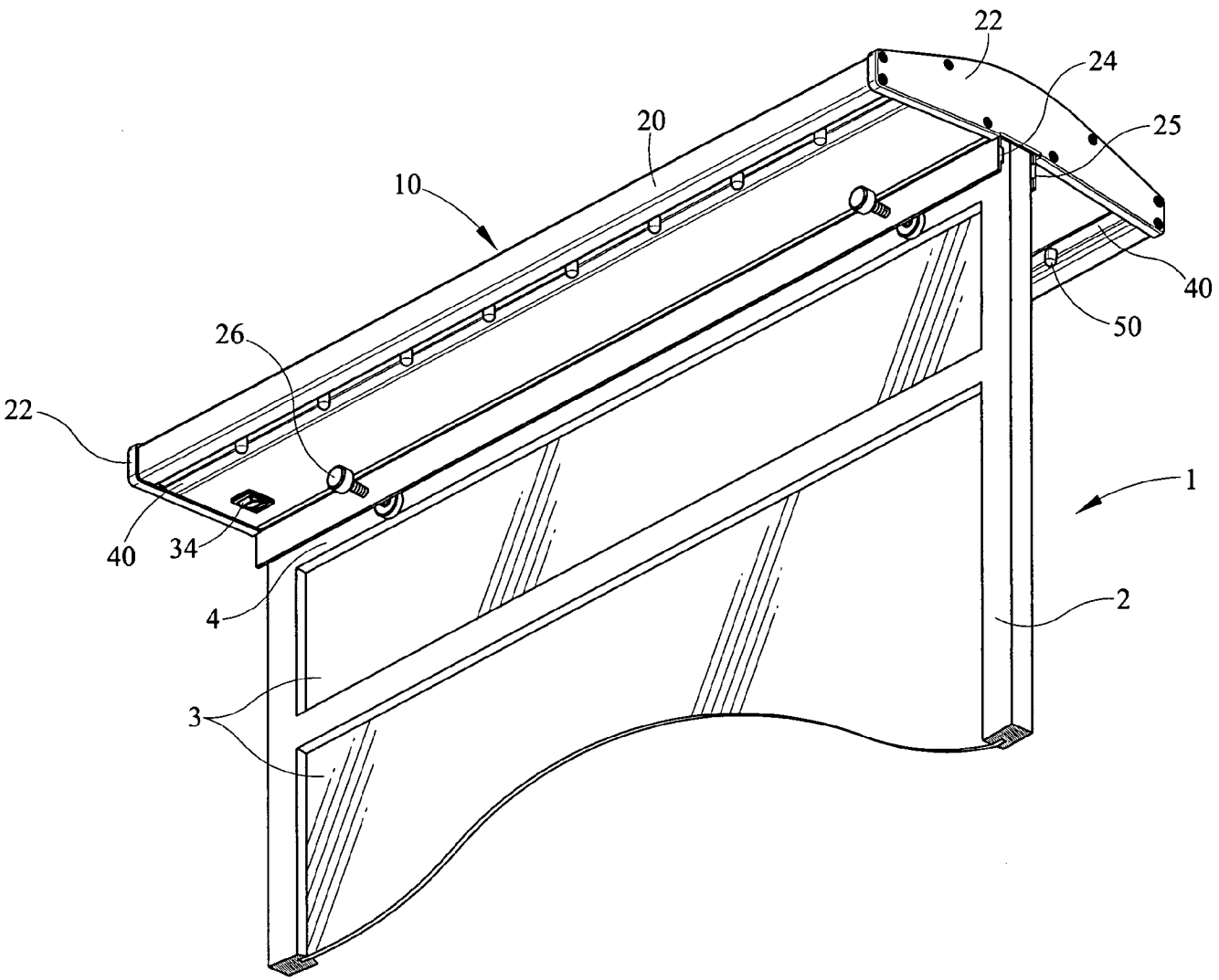
FIG. 1 is a front perspective view of the lighting apparatus according to one embodiment of the present invention installed upon a removable frame real estate sign.
Figure 2:
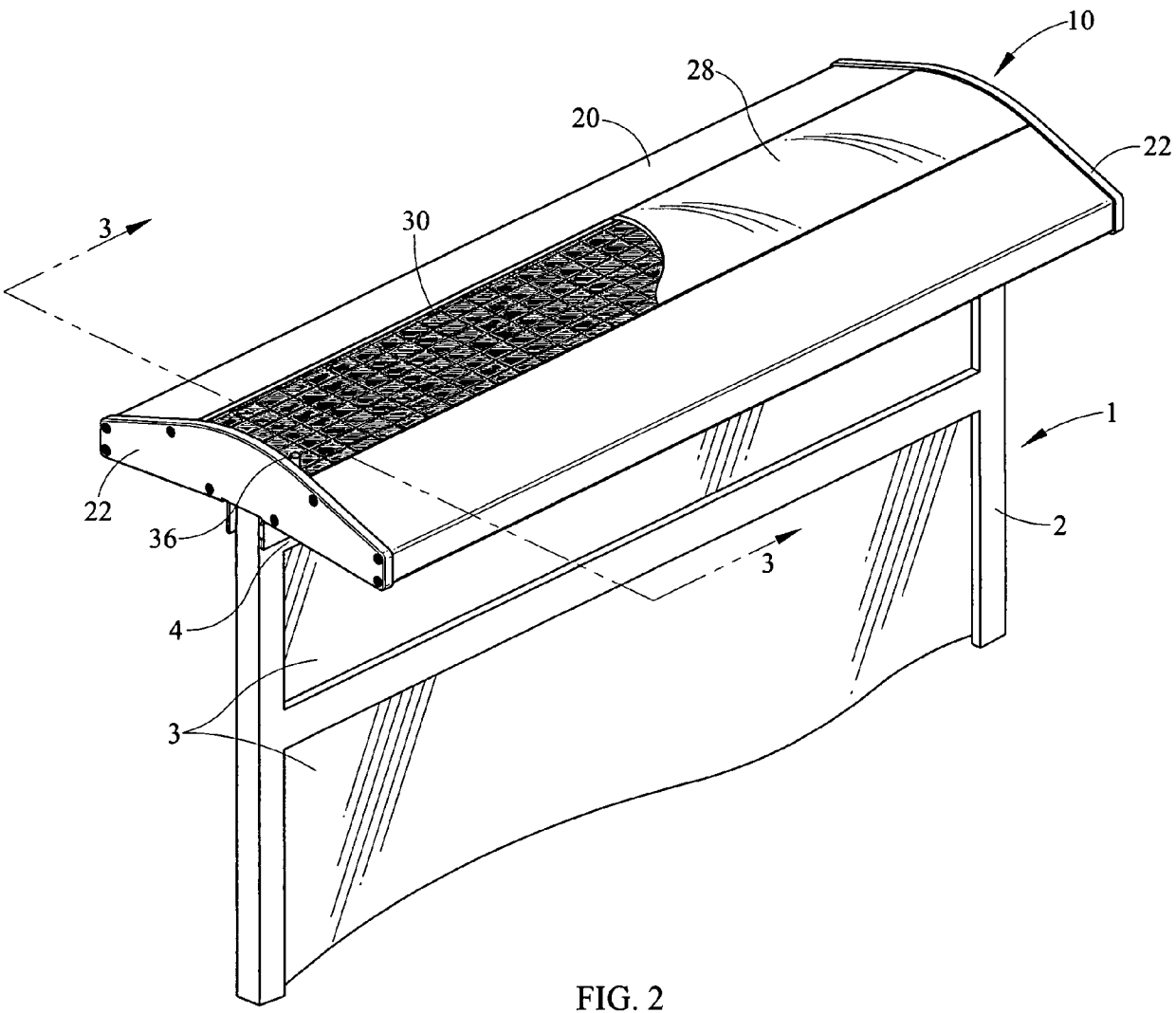
FIG. 2 is a top perspective view of the lighting apparatus with the translucent cover partially removed.

The lighting apparatus 10 of the present invention as depicted in FIG. 1 allows for the illumination of signs 1, preferably removable frame signs such as real estate signs. As shown, a lighting canopy 20 is attached to the removable sign frame 2 between parallel plates 24, 25 that position and secure the sign frame 1. Attaching the lighting apparatus to the frame of the sign and not to the sign itself allows the sign panels 3 to be interchangeably removed or replaced. As shown in FIG. 1 and FIG. 2, the lighting canopy 20 of the present invention has end covers 22, and a translucent panel 28 that covers a solar panel 30. One embodiment of the present invention as shown in the drawings has the lighting canopy 20 attached to the upper cross member 4 of the removable sign frame 2 or, alternatively to any side or sides of the frame.

Figure 3:
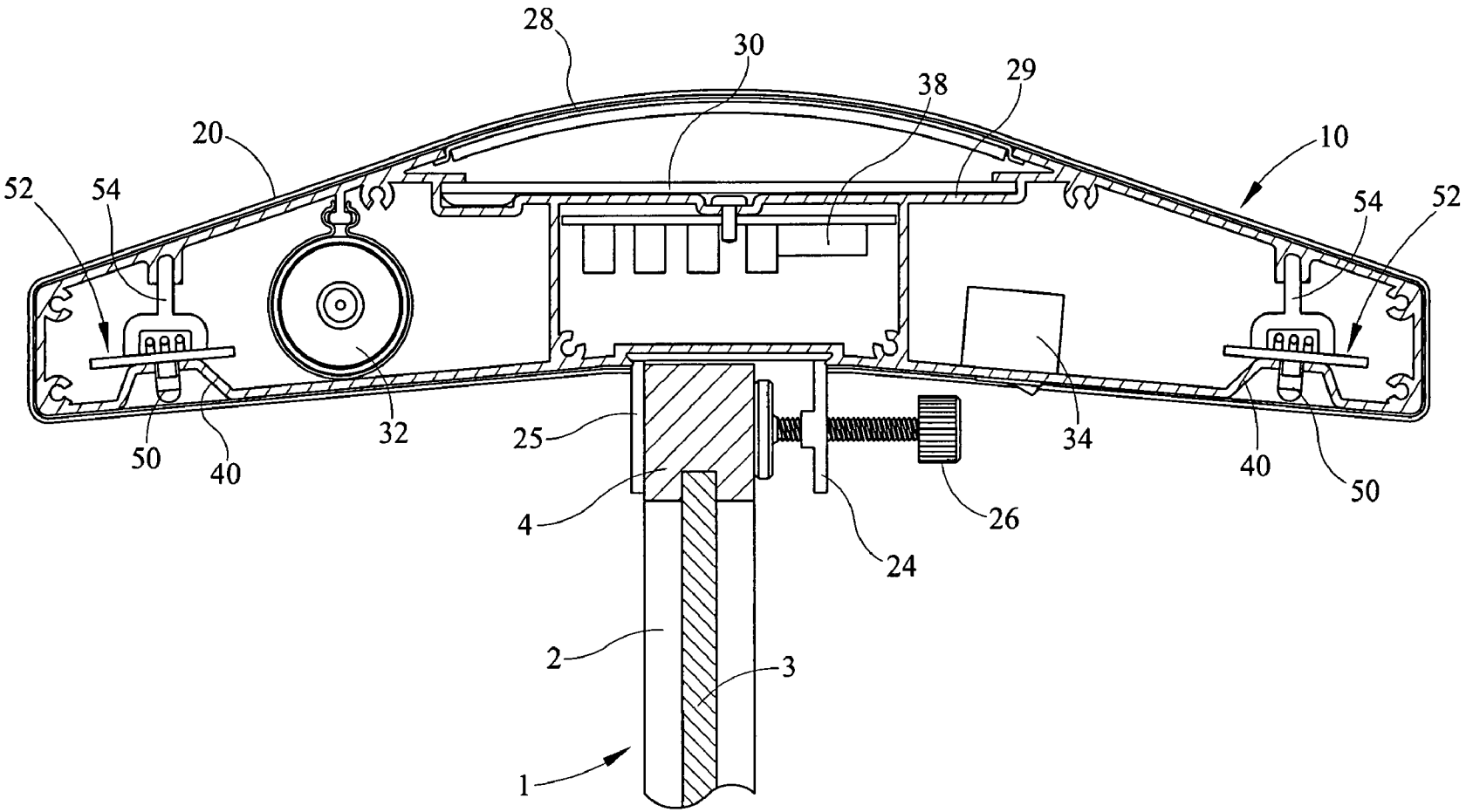
FIG. 3 is a sectional view taken along line 3-3 of FIG. 2.

As can be readily seen in FIG. 2 and FIG. 3, included within the lighting canopy 20 are the electronics necessary to power one or more light sources 50; these include a rechargeable battery 32, power on/off switch 34, light sensor 36, circuit board 38, and solar panel 30.

The circuit board 38 interacts with the electrical system to regulate the communication between the light sensor 36, rechargeable battery 32, power on/off switch 34, solar panel 30, and light sources 50. The light sensor 36 is electrically connected to the rechargeable battery 32 in such a way that current is permitted to energize the plurality of light sources 50 only when the light sensor 36 detects a level of ambient light that is below a predetermined light level. A power on/off switch 34 is used in conjunction with the electrical system to turn off the lighting apparatus 10 to maintain rechargeable battery power for later use or transportation.

Returning to FIG. 2 and FIG. 3, the lighting apparatus 10 includes a solar panel 30 mounted onto a recessed surface 29 of the lighting canopy 20 and covered over by a translucent panel 28. The solar panel 30 shape is substantially flat to maximize the light exposure reaching the surface, for example, in accordance with "Lambert's Cosine Law". According to Lambert's Cosine law, effective illumination is proportional to the cosine of the angle of incidence of the light reaching the surface, that is the cosine of the angle between the direction of the light and a line perpendicular to the surface. When a flat surface is facing the light, full on, the maximum amount of light is reaching the surface. Thus, if a solar panel shape other than flat were used then the solar panel would be less efficient. The panel 28 is preferably translucent, that is a range between 0.1% to 100% clear, allowing light to transmit through the translucent panel 28 and reach the solar panel 30.

Figure 4:
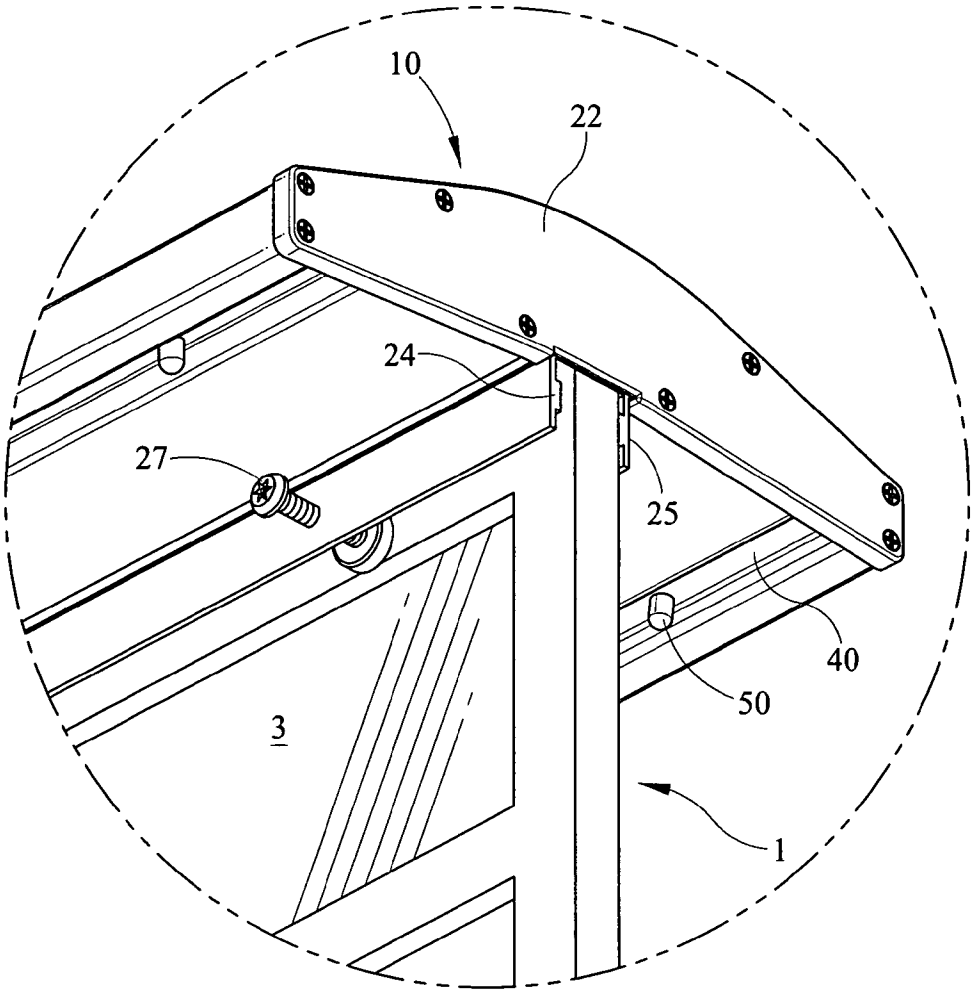
FIG. 4 is an enlarged, partial perspective view of the lighting apparatus according to one embodiment of the present invention.

As shown in FIGS. 1, 3, and 4, the under side of the lighting canopy 20 has one or more recesses 40 running longitudinally adjacent each side of the lighting apparatus to accommodate and position the light sources 50 to illuminate each side of the sign panels 3. The recesses 40 allow the light sources 50 to be recessed as shown in FIG. 3 to minimize the direct glare from the light sources 50 and to focus the emitted light onto the sign panels 3. Alternatively, the light sources 50 can be individually recessed. The plurality of light sources 50 in the present invention are preferably LEDs (light emitting diodes) spaced longitudinally in the recesses 40 due to their high lumen output relative to the power drain. Alternatively other light sources can be used. Preferably the multiplicity of longitudinally spaced LEDs are incorporated into a strip 52 and positioned respectively in the recess 40. Alternatively the LEDs can be individually spaced along the recess 40. The strip of LEDs 52 are held in position by the LED bracket 54.

As shown in FIGS. 1, 2, 3, and 4 the parallel plates 24 and 25 create a channel into which the removable sign frame 2 can be positioned between parallel plate 24 and parallel plate 25. Thumb screws 26 or a similar device, preferably security screws 27 as shown in FIG. 4, are provided in one of the parallel plates. The thumb screws 26 or security screws 27 can be tightened down to compress the upper cross member 4 of the sign, or another side, between the screws and the other parallel plate. This allows the lighting apparatus 10 to be easily detached to remove the interchangeable sign panels 3 of the removable sign frame 2. Alternatively the channel can be formed by a series of clamps, clips or similar means attached to the lighting canopy 20 which allow the lighting canopy to be removably secured to a sign.

It is understood that while certain forms of the invention have been illustrated and described, it is not limited thereto except insofar as such limitations are included in the following claims and allowable functional equivalents thereof.

I claim:

1. A combined sign and lighting apparatus adapted to be removably secured to said sign comprising:

a removable sign frame having a capability of receiving at least one sign panel, wherein said at least one sign panel includes a first side and a second side;

a lighting canopy forming an enclosed interior space and having a bottom surface, said bottom surface having a sign securing channel to secure said lighting canopy to at least one edge of said removable sign frame, said channel having an adjustable width clamp for securing said lighting canopy to a top surface of said removable sign frame;

said bottom surface having a first longitudinal illumination support area having a first plurality of light emitting illumination sources outwardly disposed from said sign securing channel wherein said first plurality of light emitting illumination sources illuminate downwardly and inwardly towards said first side of said at least one sign panel;

said bottom surface further having a second longitudinal illumination support area having a second plurality of light emitting illumination sources outwardly disposed from said sign securing channel wherein said second plurality of light emitting illumination sources illuminate downwardly and inwardly towards said second side of said at least one sign panel; and said enclosed interior space of said lighting canopy having electronics for illuminating said first and said second plurality of light emitting illumination sources.

2. The sign and lighting apparatus as in claim 1 further comprising a solar panel affixed to a top surface of said lighting canopy and having a translucent panel disposed over said solar panel.

3. The sign and lighting apparatus as in claim 2 further comprising a rechargeable battery, a light sensor, and a circuit board each electrically connected to said solar panel and located within said enclosed interior space.

4. The sign and lighting apparatus as in claim 1 wherein said channel includes two parallel plates and at least one compression mechanism passing perpendicularly through one parallel plate to clamp at least one edge of said sign between said compression mechanism and the other said parallel plate.

5. A lighting apparatus adapted to be removably secured to a separate sign comprising:

a lighting canopy having a top surface and a bottom surface, said bottom surface being substantially perpendicular to said sign;

said top surface defining a recessed surface;

a solar panel mounted onto said recessed surface and electrically connected to a rechargeable battery;

said bottom surface defining a channel adapted to removably secure said lighting canopy to at least one edge of said sign and said bottom surface defining a first longitudinal recess and a second longitudinal recess wherein said first longitudinal recess positioning a first plurality of light emitting diodes outwardly disposed from said sign securing channel and said second longitudinal recess positioning a second plurality of light emitting diodes outwardly disposed from said sign securing channel said first plurality of light emitting diodes illuminating downwardly and inwardly towards a first side of said sign and said second plurality of light emitting diodes illuminating downwardly and inwardly towards a second side of said sign;

said lighting canopy further having a light sensor for sensing ambient light electrically connected to a circuit board affixed in said lighting canopy.

6. The lighting apparatus as in claim 5 further comprising a translucent panel disposed over said solar panel.

7. The lighting apparatus as in claim 5 wherein said circuit board permits said rechargeable battery to energize said first plurality of light emitting diodes and said second plurality of light emitting diodes when said sensed level of ambient light is below a predetermined level.

8. The lighting apparatus as in claim 5 wherein said channel has two parallel opposing plates and at least one screw passing perpendicularly through one of said two opposing parallel plates to clamp at least one edge of said sign between said security screw and said opposing parallel plate.

9. A lighting apparatus adapted to be removably secured to a separate sign comprising:

a lighting canopy having a top surface and a bottom surface defining a internal cavity, said bottom surface being substantially perpendicular to said sign;

said bottom surface defining a sign securing channel attached to said lighting canopy in position to removably secure said lighting canopy to at least one edge of said sign, wherein said sign further having a first side and a second side, and said channel further having an adjustable compression screw securing said lighting canopy to said sign;

said bottom surface defining a first longitudinal illumination support area having a first plurality of light emitting illumination sources outwardly disposed from said sign securing channel, wherein said first plurality of light emitting illumination sources illuminate downwardly and inwardly towards said first side of said sign;

said bottom surface defining a second longitudinal illumination support area having a second plurality of light emitting illumination sources outwardly disposed from said sign securing channel, wherein said second plurality of light emitting illumination sources illuminate downwardly and inwardly towards said second side of said sign;

said top surface of said canopy having a translucent longitudinal panel disposed over a recessed solar panel affixed within said internal cavity of said lighting canopy; and said internal cavity of said lighting canopy having a rechargeable solar battery in electrical communication with a circuit board and a light sensor controlling the illumination of said first and said second plurality of light emitting illumination sources.

10. A combined sign and lighting apparatus adapted to be removably secured to said sign comprising:

a removable sign frame having a capability of receiving at least one sign panel, wherein said at least one sign panel includes a first side and a second side;

a lighting canopy having a top surface and a bottom surface wherein said bottom surface is substantially perpendicular to and above said sign panel said lighting canopy further having a recessed solar panel disposed downwardly from a longitudinal translucent panel of said top surface;

a sign securing channel attached to said lighting canopy in position to secure said lighting canopy to at least one edge of said removable sign frame, wherein said sign securing channel includes two parallel plates depending from said bottom surface of said lighting canopy, wherein said bottom surface of said lighting canopy is substantially positioned above said two parallel plates, and at least one compression mechanism passing perpendicularly through one parallel plate to clamp said at least one edge of said removable sign frame between said compression mechanism and the other said parallel plate;

said bottom surface of said lighting canopy defining a first longitudinal illumination recess area having a first plurality of light emitting diodes outwardly disposed from said sign securing channel, wherein said first plurality of light emitting diodes illuminate downwardly and inwardly towards said first side of said at least one sign panel; and said bottom surface of said lighting canopy defining a second longitudinal illumination recess area having a second plurality of light emitting diodes outwardly disposed from said sign securing channel, wherein said second plurality of light emitting diodes illuminate downwardly and inwardly towards said second side of said at least one sign panel.

11. A lighting apparatus adapted to be removably secured to a separate sign comprising:

a removable sign frame having a capability of receiving at least one sign panel, said at least one sign panel having a first side and a second side;

a longitudinal lighting canopy having a top surface and a bottom surface enclosed at each distal end by an end cover forming an internal space, said bottom surface being substantially perpendicular to said at least one sign panel, said top surface having a longitudinal translucent panel disposed over an internal enclosed solar panel, said internal space of said lighting canopy having electronics for illuminating a first and a second plurality of light emitting diodes;

an attachment mechanism depending from said bottom surface to secure said lighting canopy to at least one edge of said removable sign frame;

said bottom surface defining a first longitudinal recess outwardly disposed from said attachment mechanism between each of said end covers and a second longitudinal recess outwardly disposed from said attachment mechanism between each of said end covers;

said first plurality of light emitting diodes positioned in said first longitudinal recess such that said first plurality of light emitting diodes provides substantially even illumination across the surface of said first side of said at least one sign panel;

said second plurality of light emitting diodes positioned in said second longitudinal recess such that said second plurality of light emitting diodes provides substantially even illumination across the surface of said second side of said at least one sign panel; and said first recess is sufficiently deep so that each of said first plurality of light emitting diodes is fully recessed to minimize direct glare to the observer while illuminating said first side of said at least one sign panel; and said second recess is sufficiently deep so that each of said second plurality of light emitting diodes is fully recessed to minimize direct glare to the observer while illuminating said second side of said at least one sign panel.

12. The lighting apparatus as in claim 11 wherein either said first plurality of light emitting diodes or said second plurality of light emitting diodes evenly illuminates to a distal edge of said at least one sign panel in a direction away from said lighting canopy.

13. The lighting apparatus as in claim 11 wherein said first longitudinal recess and said second longitudinal recess are substantially parallel to said attachment mechanism.

14. The lighting apparatus as in claim 11 wherein each said first longitudinal recess and said second longitudinal recess is substantially polygonal in shape.

15. The lighting apparatus as in claim 11 wherein each said first longitudinal recess and said second longitudinal recess is discontinuous along the length of said attachment mechanism.

16. The lighting apparatus as in claim 11 wherein each said first longitudinal recess and said second longitudinal recess is continuous along the length of said attachment mechanism.

17. The lighting apparatus as in claim 11 wherein said attachment mechanism is a channel.

18. The combined sign and lighting apparatus as in claim 10 wherein each said first longitudinal recess area and said second longitudinal recess area is discontinuous along the length of said channel.

19. The combined sign and lighting apparatus as in claim 10 wherein each said first longitudinal recess area and said second longitudinal recess area is continuous along the length of said channel.

20. The combined sign and lighting apparatus as in claim 1 wherein said first longitudinal illumination support area is a first recess and said second longitudinal illumination support area is a second recess.

* * * * *